US009903661B2

(12) United States Patent
Odillard et al.

(10) Patent No.: US 9,903,661 B2
(45) Date of Patent: Feb. 27, 2018

(54) HEAT EXCHANGER PLATE WITH BYPASS ZONE

(75) Inventors: Laurent Odillard, Le Luart (FR); Jean-Pierre Galland, Les Essarts-le-Roi (FR); Sebastien Devedeux, Versailles (FR); Demetrio Onetti, Saint Brice Courcelles (FR)

(73) Assignee: VALEO SYSTEMES THERMIQUES, Les Mesnil Saint Denis (FR)

( * ) Notice: Subject to any disclaimer, the term of this patent is extended or adjusted under 35 U.S.C. 154(b) by 967 days.

(21) Appl. No.: 14/129,620

(22) PCT Filed: Jun. 28, 2012

(86) PCT No.: PCT/EP2012/062585

§ 371 (c)(1),
(2), (4) Date: Apr. 2, 2014

(87) PCT Pub. No.: WO2013/001012

PCT Pub. Date: Jan. 3, 2013

(65) Prior Publication Data

US 2014/0216700 A1 Aug. 7, 2014

(30) Foreign Application Priority Data

Jun. 30, 2011 (FR) ..... 11 02061

(51) Int. Cl.
*F28F 3/00* (2006.01)
*F28D 9/00* (2006.01)
(Continued)

(52) U.S. Cl.
CPC ..... *F28D 9/00* (2013.01); *F28D 9/0006* (2013.01); *F28D 9/0043* (2013.01);
(Continued)

(58) Field of Classification Search
CPC ..... F28D 9/00; F28D 9/0006; F28D 9/0043; F28D 2021/0082; F28D 9/0056; F28D 9/005; F28F 13/06
(Continued)

(56) References Cited

U.S. PATENT DOCUMENTS 4,379,486 A * 4/1983 Kurihara ..... F25B 39/022 165/153
6,241,011 B1 * 6/2001 Nakamura ..... F25B 39/024 165/153
(Continued)

FOREIGN PATENT DOCUMENTS

DE 42 37 672 A1 5/1994
FR 2 855 604 A1 12/2004
(Continued)

OTHER PUBLICATIONS

FR2855604A1 Machine Translation.*
(Continued)

*Primary Examiner* — Claire Rojohn, III
(74) *Attorney, Agent, or Firm* — Howard & Howard Attorneys PLLC

(57) ABSTRACT

A plate (30) for a heat exchanger (50) is stackable with another plate (30) of the heat exchanger (50) to form a pair of plates (30). The pair of plates (30) are arranged to permit the circulation of a fluid to be cooled between the pair of plates (30). The plate (30) exhibits an exchange zone (ZE) to encourage the exchange of heat with the fluid. The plate (30) also exhibits a bypass zone (ZBP) capable of allowing the fluid to bypass the exchange zone (ZE). The plate (30) comprises means (36, 37) originating from the plate (30) configured in such a way as to force a circulation of the fluid in the exchange zone (ZE). A core (52) of plates comprising
(Continued)

a plurality of the plates (30), as well as a heat exchanger (50) comprising the core (52), are also disclosed.

18 Claims, 4 Drawing Sheets

(51) Int. Cl.
*F28F 9/00* (2006.01)
*F28F 13/06* (2006.01)
*F28D 21/00* (2006.01)

(52) U.S. Cl.
CPC ..... *F28D 9/0056* (2013.01); *F28F 9/005* (2013.01); *F28F 13/06* (2013.01); *F28D 2021/0082* (2013.01)

(58) Field of Classification Search
USPC ..... 165/166, 167
See application file for complete search history.

(56) References Cited

U.S. PATENT DOCUMENTS

| | | | | |
|---|---|---|---|---|
| 7,036,565 | B2 * | 5/2006 | Brost | F28D 9/0043 165/103 |
| 2002/0014326 | A1 * | 2/2002 | Nakado | F28D 1/0341 165/153 |
| 2008/0041556 | A1 * | 2/2008 | Braun | F02B 29/0462 165/41 |
| 2010/0096101 | A1 * | 4/2010 | Braun | F02B 29/0462 165/41 |
| 2011/0083833 | A1 * | 4/2011 | Zorzin | F28D 9/005 165/166 |
| 2012/0273177 | A1 * | 11/2012 | Kim | F28D 9/005 165/164 |
| 2015/0129183 | A1 * | 5/2015 | Peskos | F28F 9/0265 165/166 |
| 2016/0010929 | A1 * | 1/2016 | Takahashi | F28F 3/027 165/166 |

FOREIGN PATENT DOCUMENTS

| | | | | |
|---|---|---|---|---|
| FR | 2855604 | A1 * | 12/2004 | F28D 9/0043 |
| FR | 2 906 017 | A1 | 3/2008 | |
| JP | 2005-055087 | A | 3/2005 | |

OTHER PUBLICATIONS

International Search Report for Application No. PCT/EP2012/062585 dated Sep. 27, 2012, 5 pages.
English language abstract and machine-assisted English translation for DE 42 37 672 extracted from espacenet.com database on May 21, 2014, 19 pages.
English language abstract and machine-assisted English translation for FR 2 855 604 extracted from espacenet.com database on May 21, 2014, 26 pages.
Machine-Assisted English language abstract and Machine-Assisted English language translation for FR 2 906 017 extracted from espacenet.com database on May 21, 2014, 38 pages.
English language abstract and machine-assisted English translation for JP 2005-055087 extracted from PAJ database on May 21, 2014, 29 pages.

* cited by examiner

HEAT EXCHANGER PLATE WITH BYPASS ZONE

RELATED APPLICATIONS

This application is the National Stage of International Patent Application No. PCT/EP2012/062585, filed on Jun. 28, 2012, which claims priority to and all the advantages of French Patent Application No. FR 11/02061, filed on Jun. 30, 2011, the content of which is incorporated herein by reference.

The invention relates to a plate for a heat exchanger of a motor vehicle, a core of plates of such an exchanger and a heat exchanger equipped with such a core. It relates in particular to the field of charge air coolers.

An engine for a motor vehicle comprising a turbocharger and referred to as a turbocharged engine is already familiar. In order to function, such a turbocharged engine may be supplied by a system for the admission of air or by a system for the admission of a mixture of air and exhaust gases collected at the exhaust from the engine, referred to as recirculated exhaust gases. The expression charge air for the engine is used below to denote both the air coming from a system for the admission of air and the mixture coming from a system for the admission of a mixture of air and recirculated exhaust gases.

With the aim of increasing the density of the charge air for the engine, it is familiar from the prior art to cool the said charge air by means of a heat exchanger, also referred to as a charge air cooler (RAS).

First of all, use has been made primarily of charge air coolers of the tubes and inserts type permitting an exchange of heat between the charge air circulating inside the tubes and a flow of air coming from the exterior of the vehicle and circulating between the tubes.

Heat exchangers comprising a core formed from a stack of superposed plates, allowing an exchange of heat between the charge air and a coolant fluid, in general a liquid, have also been proposed. A plate is in the form of a rectangular elongated panel comprising two transcurrent ports. The stacked plates alternatively form circulation channels for the charge air to be cooled and circulation channels for the coolant fluid.

The charge air to be cooled enters into the heat exchanger via one of its lateral faces, referred to as the upstream face, in such a way as to circulate in the circulation channels for the charge air to be cooled, in order to be cooled by contact with the plates situated above and below inside which the coolant fluid circulates. The cooled charge air then exits from the exchanger via the opposite lateral face, referred to as the downstream face. The expressions "upstream" and "downstream" are also used in the rest of the description to designate, respectively, the inlet and the outlet for the flow of charge air in the core of the heat exchanger.

In order to cause the coolant fluid to circulate inside the exchanger, inlet channels and collection channels for the coolant fluid are provided in a part of the core. The plates thus comprise raised edges, around each of their two ports, extending perpendicularly to the plane of the plate in such a way as to form these inlet channels and collection channels for the coolant fluid when the plates are stacked.

The part of the core of the exchanger corresponding to the inlet channels and collection channels for the coolant fluid does not, however, participate in the exchange of heat. An exchange zone intended to encourage the exchange of heat with the fluid and a zone permitting the fluid to bypass the said exchange zone, referred to as the bypass zone, corresponding to the zone in which the inlet channels and collection channels for the coolant fluid are formed, can thus be observed. More specifically, the spaces situated around the ports permit the circulation of charge air uncooled, or insufficiently cooled, from the upstream towards the downstream of the core, which presents major inconveniences in terms of the thermal performance.

A device 10, illustrated in FIG. 1, comprising a wall 12 attached to the lateral upstream face 14 of the exchanger and allowing a part of the flow of charge air to be prevented from entering into the core of the exchanger at the level of the bypass zone, is already familiar. Such a device is not satisfactory, however, in particular for reasons of assembly.

In order to improve the situation, the invention relates to a plate for a heat exchanger, the said plate being intended to be stacked with another plate of a heat exchanger in order to form a pair of plates arranged in order to permit, between the said plates, the circulation of a fluid to be cooled, the plate exhibiting a zone, referred to as the exchange zone, intended to encourage the exchange of heat with the fluid, and a zone, referred to as the bypass zone, capable of permitting the fluid to bypass the said exchange zone, the plate being characterized in that it comprises in addition means originating from the plate configured in such a way as to force a circulation of the fluid in the exchange zone.

The bypass zone is thus created by means originating from the plate. These means are accordingly created at the time of the manufacture of the plate and are no longer required to be attached to the core, as was the case in previous solutions.

Preferably, the means originating from the plate extend perpendicularly to the plane of the plate. Such a configuration facilitates the circulation of the fluid towards the exchange zone.

Advantageously, the plate is in the form of a panel comprising two upstream and downstream edges and comprising, in the bypass zone, an inlet port for a coolant fluid and a collection port for the said coolant fluid, the means originating from the plate comprising an upstream partition extending from the upstream edge of the plate and configured in such a way as to block the circulation of the fluid at the level of the inlet port and/or a downstream partition extending from the downstream edge of the plate and configured in such a way as to block the circulation of the fluid at the level of the collection port.

According to one aspect of the invention, the lengths of the upstream partition and/or of the downstream partition are identical or greater than the largest dimension of the ports in the direction of the upstream and/or downstream edges. The fluid to be cooled is thus directed in its entirety towards the exchange zone, which makes the heat exchanger even more efficient.

According to a further aspect of the invention, the plate is rectangular and exhibits two long edges and two short edges, the said long edges defining the said upstream and downstream edges, the inlet port and the collection port being pierced in a zone close to one of the short edges.

According to one aspect of the invention, the upstream and downstream partitions are parallel.

According to one aspect of the invention, the upstream and downstream partitions exhibit an oblique distal edge.

According to a further aspect of the invention, the means originating from the plate comprise a central partition extending between the inlet port and the collection port.

The invention also relates to a core comprising a plurality of plates as defined above stacked one on top of the other in such a way that two adjacent plates, forming a pair, define a circulation channel for the fluid to be cooled, and two plates of two different and adjacent pairs form a circulation channel for the coolant fluid.

According to one aspect of the invention, the partitions of two plates of one and the same pair of plates overlap.

Advantageously, a turbulator is arranged between two plates of one and the same pair of plates in such a manner as to encourage the exchange of heat between the fluid to be cooled and the coolant fluid, the said turbulator having a height substantially identical to that of the partitions.

The invention also relates to a heat exchanger comprising a core as defined above.

Other characteristics and advantages of the invention will be appreciated from the following description made with respect to the accompanying figures that are provided by way of non-limiting examples. Identical reference designations are given to similar objects.

FIG. 1, which has already been commented upon, is a top view of a familiar plate of a core of a heat exchanger.

FIG. 2 depicts a familiar heat exchanger 20 with a familiar core 21 of plates. It should be noted that the plates according to the invention may be utilized in an exchanger of this type in place of the familiar plates.

Such a heat exchanger 20 permits the exchange of heat between a fluid to be cooled and a coolant fluid. In the rest of the description, the fluid to be cooled is air. This does not have any restrictive effect on the scope of the present invention, for which, in another type of heat exchanger, the fluid to be cooled could be another gas.

Figure 1:
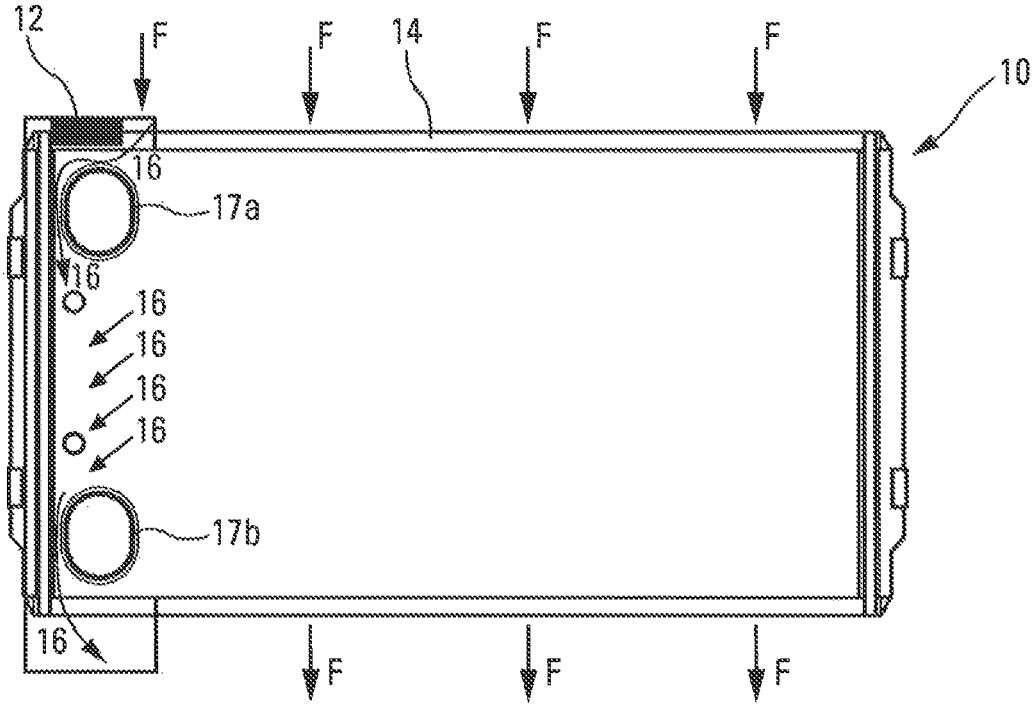
Figure 2:
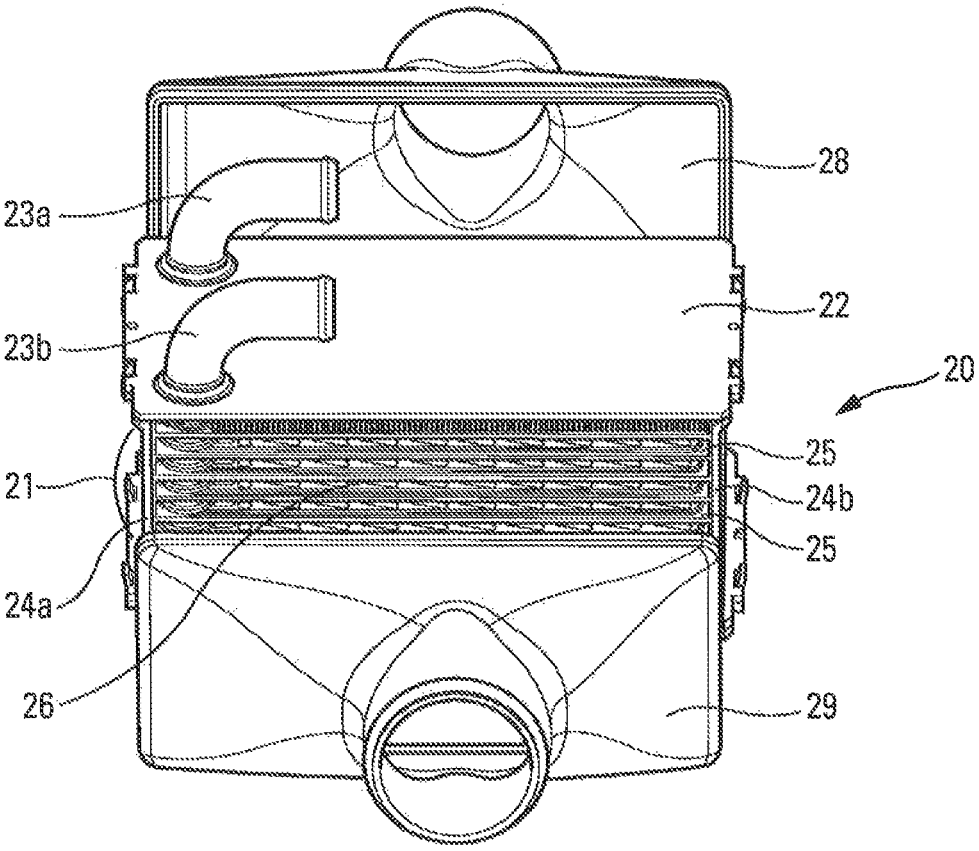
FIG. 2 is a perspective view, partially exploded, of a familiar heat exchanger.

The heat exchanger 20, illustrated in FIG. 2, comprises:

- an upper wall 22 comprising an inlet pipe 23*a* for a coolant fluid and a collection pipe 23*b* for the said cooling liquid,
- two lateral walls 24*a* and 24*b*,
- one open lateral upstream face (not visible) and one open lateral downstream face 26,
- a lower wall, and
- a core 21 comprising a plurality of pairs of plates 25 stacked one on top of the other between the lower wall and the upper wall 22.

Such a core 21 permits an exchange of heat between the charge air and the coolant fluid, in general a liquid. For this purpose, the stacked plates 25 alternately form circulation channels for the charge air to be cooled and circulation channels for the coolant fluid. More specifically, two plates 25 of one and the same pair form a circulation channel for the charge air to be cooled, and two plates 25 of two different and adjacent pairs form a circulation channel for the coolant fluid.

In order to cause the coolant fluid to circulate between the plates 25 of the core 21 of the exchanger 20, inlet channels and collection channels for the coolant fluid are provided in a part of the core 21.

The inlet pipe 23*a* and the collection pipe 23*b* of the exchanger 20 respectively permit the inlet and the collection of the coolant fluid in the circulation channels for the coolant fluid.

In order to admit the air to be cooled, an inlet box 28 for air to be cooled may be installed on the open lateral upstream face of the heat exchanger 20. Similarly, in order to collect the air, after having been cooled by its passage between the plates of the heat exchanger 20, a collecting box 29 for the cooled air may be installed on the open lateral downstream face 26 of the heat exchanger 20.

The coolant fluid thus enters the heat exchanger via the inlet pipe, circulates inside the inlet channel, circulates between the pairs of plates stacked in the circulation channels for the fluid, and then exits from the exchanger via the collection channel and then the collection pipe.

Figure 3:
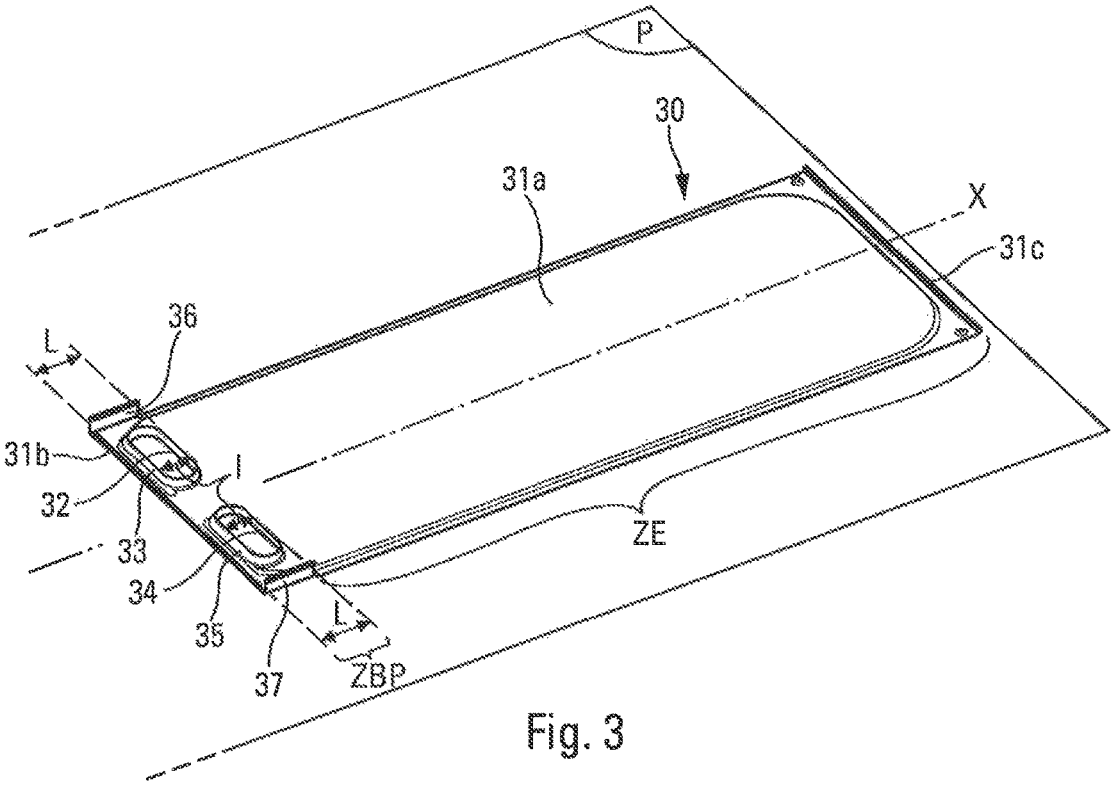
FIG. 3 is a perspective view of a plate according to the invention.

In order to eliminate some of the previously mentioned drawbacks of the prior art, the invention relates to a plate 30 of a core for a heat exchanger, as illustrated in FIG. 3. Such a plate 30 is present here in the form of a rectangular, elongated panel extending in a plane P along a longitudinal axis X and comprising an upper face (31*a*), a lower face (not visible), two extremities 31*b* and 31*c*, an inlet port 32 for the coolant fluid and a collection port 34 for the coolant fluid, provided in a zone close to one 31*b* of the extremities of the plate 30. The plate exhibits the form of bowl (inverted in FIG. 3), the inlet port 32 and the collection port 34 communicating with the bottom of the bowl in order to define one or a plurality of circulation channels for coolant fluid.

The plate 30 comprises, around the inlet port 32 for the coolant fluid, an edge 33 extending perpendicularly to the plane P of the plate 30. Similarly, the plate 30 comprises, around the collection port 34 for the coolant fluid, an edge 35 extending perpendicularly to the plane P of the plate 30. The edges 33 and 35 permit the inlet channel and the collection channel respectively for the coolant fluid to be formed perpendicularly to the plane P of the plate, for the height of the core formed by the stack of plates 30.

The plate 30 exhibits a zone, referred to as the exchange zone, ZE, intended to encourage the exchange of heat between the air and the coolant fluid and a zone, referred to as the bypass zone, ZBP, capable of permitting the air to bypass the said exchange zone ZE.

In the plate 30 according to the invention illustrated in FIG. 3, means originating from the plate are configured in such a way as to force a circulation of the fluid inside the exchange zone ZE. They are present here in the form of:

- an upstream partition 36 having a length L extending from the edge of the plate 30, substantially perpendicularly to the plane P of the plate 30, at the level of the port 32, along an axis perpendicular to the longitudinal axis of the plate 30, and
- a downstream partition 37 having a length L extending from the edge of the plate 30, substantially perpendicularly to the plane P of the plate 30, at the level of the port 34, along an axis perpendicular to the longitudinal axis of the plate 30.

The bypass zone ZBP thus extends between the upstream partition 36 and the downstream partition 37. The exchange zone extends over the rest of the plate 30. And the passage of the air at the level of the said bypass zone ZBP is blocked.

Figure 4:
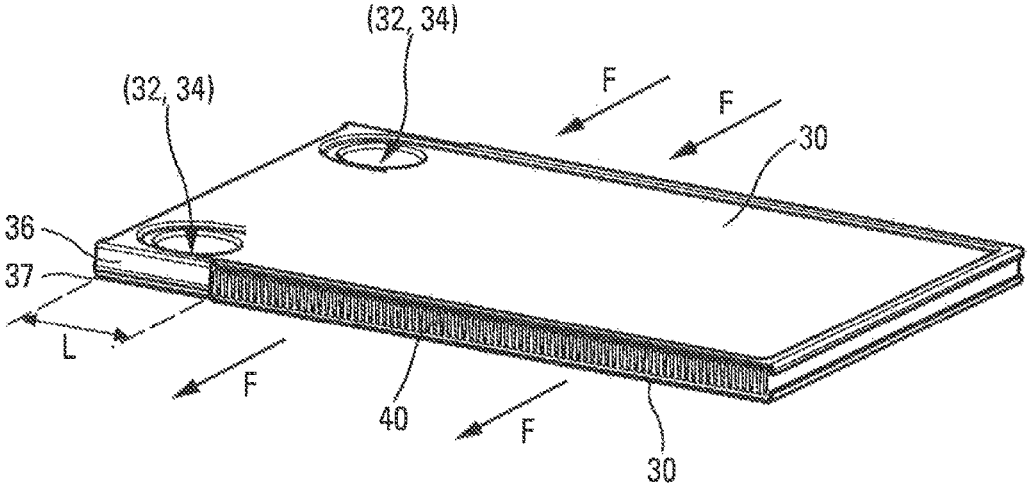
FIG. 4 is a perspective view of a pair of plates according to the invention, between which a turbulator is inserted.

Two plates 30 according to the invention may be assembled one on top of the other, as illustrated in FIG. 4, as a pair of plates 30, in such a way as to form a circulation channel for the flow of air F to be cooled. More specifically, a plate 30 as illustrated in FIG. 3 may be inverted and arranged on another, non-inverted plate 30, as illustrated in FIG. 3, in such a way as to form the said pair. It should be noted that the size of the edges 33 and 35 extending from the contour of the ports perpendicularly to the plane P of the plate 30 may be different between the two plates of one and the same pair of plates, in such a way that they are complementary and fit together in order to form the inlet and collection channels when the two plates are assembled as a single pair.

As illustrated in FIG. 4, an internal insert or turbulator 40 may be inserted, for example before assembly, between two plates 30 of a pair of plates 30. Such a turbulator 40 permits the exchange of heat to be improved.

The bypass zone ZBP is defined substantially by the space created between the upstream partition 36, the downstream partition 37 and the two plates 30 assembled as a pair of plates 30. The exchange zone ZE is defined substantially, between the two plates 30 assembled as a pair of plates 30, by the space for the circulation of the air, into which the turbulator 40 is inserted.

Figure 5:
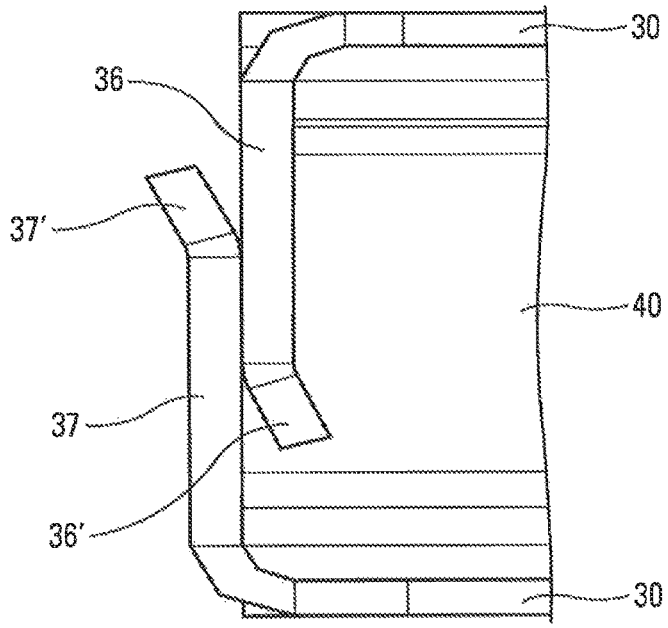
FIG. 5 is a partial view in cross section of a pair of plates according to the invention illustrating the superposition of a partition of one of the plates with a partition of the other plate.

As illustrated in FIG. 5, which is a view in cross section perpendicular to the longitudinal axis X of the plate 30 of an assembled pair of plates 30, the distal extremities 36' and 37', respectively of the partitions 36 and 37, may be configured in such a way that the partitions 36 and 37 are superposed, overlap or fit together easily.

For this purpose, the partitions 36 and 37 may, for example, exhibit oblique distal edges. In FIG. 5, the distal extremity 36' is curved towards the interior of the space defined by the assembly of two plates 30, and the distal extremity 37' is curved towards the exterior of the space defined by the assembly of two plates 30. Thus, when the two plates are superposed in order to be assembled as a pair of plates 30, the opposing curves of the distal extremities 36' and 37' make the assembly of the two plates 30 easier.

For the same purpose, the partitions 36 and 37 of one and the same plate 30 are not symmetrical in relation to the longitudinal axis X of the said plate 30. Thus, when two same plates 30 of one and the same pair of plates are opposite one another, with one of the plates being rotated through 180° about the longitudinal axis X in relation to the other, the partition 36 of one of the plates is offset in the direction of the small sides of the plates 30, in relation to the partition 37 of the other plate, which facilitates their overlapping.

Figure 6:
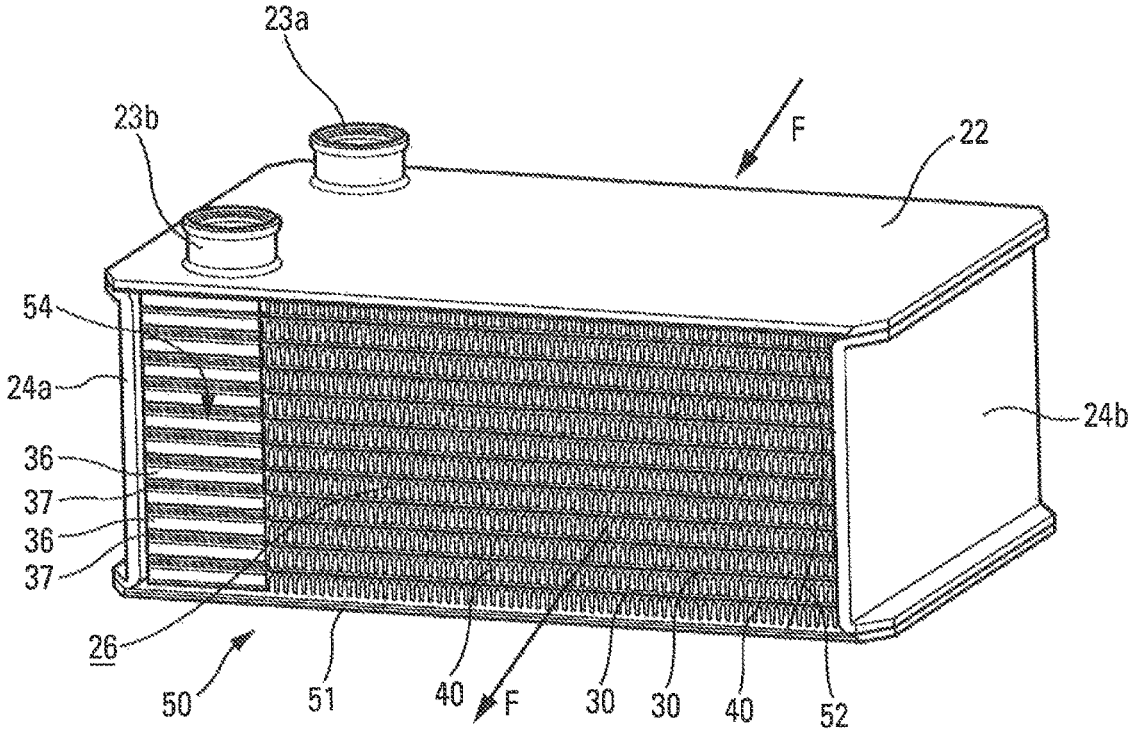
FIG. 6 is a perspective view of a heat exchanger comprising a plurality of pairs of plates according to the invention.

As illustrated in FIG. 6, when the pair of plates 30 is installed in a heat exchanger 50, the flow of air F passes through the core 52, between each pair of plates 30, defining a circulation channel for air to be cooled, from the upstream towards the downstream, in such a way as to be cooled by the circulating coolant fluid, inside each channel for circulation of the coolant fluid, between the plates 30 of two different pairs.

The partitions 36 and 37 made from the material of the plate 30 form an upstream wall (not visible), by stacking the plates 30, allowing the flow of air F to be blocked at the level of the lateral upstream face of the heat exchanger 50, and a downstream wall 54 allowing the flow of air F to be blocked at the level of the lateral downstream face of the heat exchanger 50. The upstream and downstream walls 54 thus prevent the circulation of air at the level of the bypass zone of the core. The exchange zone ZE is defined between the upstream and downstream portions of the core, which are open for the circulation of the air to be cooled.

It should be noted that, in FIG. 6, the inlet pipe 23*a* and the collection pipe 23*b* are depicted only partially, for reasons of clarity, and that the lower wall 51 of the heat exchanger 50 is visible.

In the described embodiment, the means originating from the plate configured in such a way as to force a circulation of the fluid in the exchange zone ZE are arranged both on the upstream face and on the downstream face 26 of the heat exchanger 50. In a further embodiment of the invention, the means originating from the plate could only be arranged, for example, on the upstream face of the heat exchanger 50.

Figure 7:
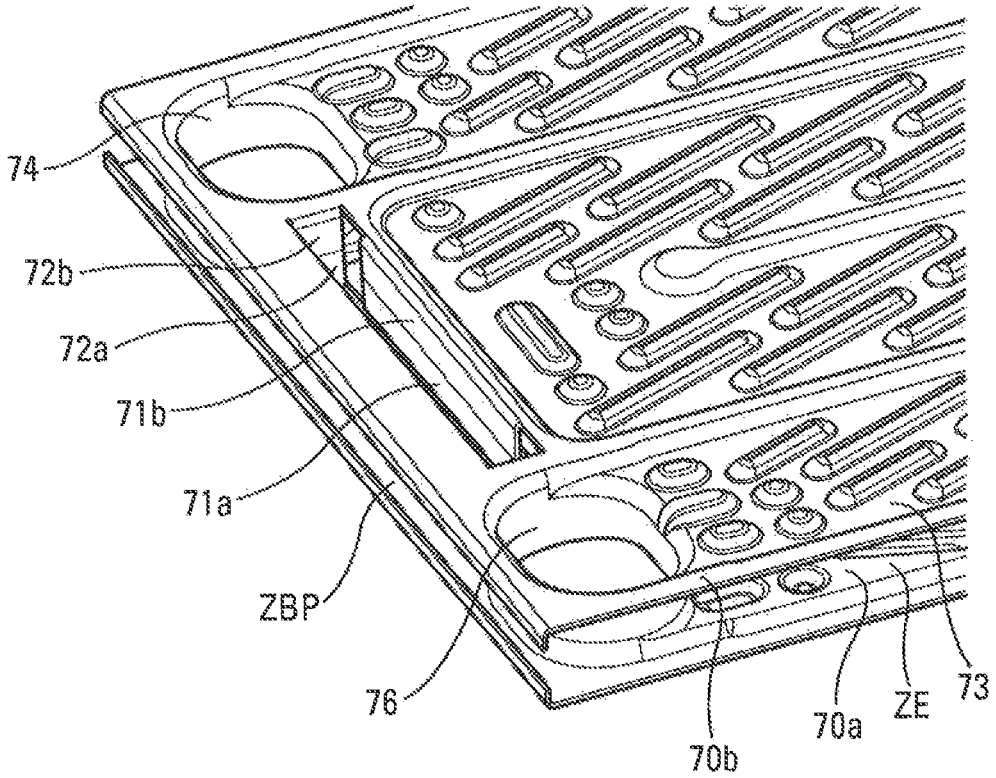
FIG. 7 is a partial view in perspective of a pair of plates according to the invention comprising a partition between the inlet ports and the collection ports for the coolant liquid.

In an embodiment illustrated in FIG. 7, the plate 70 comprises a central partition extending between the inlet port 74 and the collection port 76 forming the circulation channels for the coolant fluid. This central partition in this case is made from the material of the two plates 70*a* and 70*b* and comprises two raised edges 71*a* and 71*b* extending substantially perpendicularly to the plates 70*a* and 70*b* in such a way as to block the flow of air between the exchange zone ZE and the bypass zone ZBP. The central partition furthermore comprises raised edges 72*a* and 72*b* in order to increase the blocking of the flow between the exchange zone ZE and the bypass zone ZBP between the inlet port 74 and the collection port 76.

The bowl-shaped form 73 of the plate 70*b*, arranged to guide the coolant fluid between the inlet port 74 and the collection port 76, can also be appreciated from this figure.

The plates 30, as well as the rest of the core, are advantageously made of metal, for example aluminium and/or aluminium alloys.

The invention claimed is:

1. A plate for a heat exchanger, said plate being stackable with another plate of the heat exchanger to form a pair of plates arranged to permit a circulation of a fluid to be cooled between the pair of plates, said plate exhibiting an exchange zone to encourage a exchange of heat with the fluid, and exhibiting a bypass zone capable of permitting the fluid to bypass the said exchange zone, said plate comprising means originating from said plate configured in such a way as to force a circulation of the fluid in said exchange zone, wherein said plate is in a form of a panel comprising two upstream and downstream edges in which said plate is rectangular and exhibits two long edges and two short edges, said long edges defining said upstream and downstream edges and comprising an inlet port in said bypass zone for a coolant fluid and a collection port for the coolant fluid, said means originating from said plate comprising an upstream partition extending from said upstream edge of said plate and configured in such a way as to block the circulation of the fluid at a level of said inlet port and/or said plate comprising a downstream partition extending from said downstream edge of said plate and configured in such a way as to block the circulation of the fluid at a level of said collection port, wherein said inlet port, said upstream partition, said downstream partition, and said collection port are disposed in line in a downstream direction and wherein said bypass zone extends between said upstream partition and said downstream partition and said exchange zone extends over a remainder of said plate.

2. The plate according to claim 1, in which said means originating from said plate extend perpendicularly to a plane of said plate.

3. The plate according to claim 1, in which said inlet port and said collection port being pierced in a zone close to one of said short edges.

4. The plate according to claim 3, in which the lengths of said upstream partition and/or of said downstream partition are identical to or greater than the largest dimension of said ports in the direction of said long edges.

5. The plate according to claim 1, in which said upstream and downstream partitions are parallel.

6. The plate according to claim 1, in which said upstream and downstream partitions exhibit an oblique distal end.

7. The plate according to claim 1, in which said means originating from said plate comprise a central partition extending between said inlet port and said collection port.

8. A core of plates comprising a plurality of plates according to claim 1, stacked one on top of the other in such a way that two adjacent plates forming a pair define a circulation channel for the fluid to be cooled and two plates of two different and adjacent pairs form a circulation channel for a coolant fluid.

9. The core according to claim 8, in which upstream and downstream partitions of two plates of one and the same pair of plates overlap.

10. The core according to claim 9, in which a turbulator is arranged between two plates of one and the same pair of plates in such a manner as to encourage the exchange of heat between the fluid to be cooled and the coolant fluid, said turbulator having a height substantially identical to that of said partitions.

11. A heat exchanger comprising the core according to claim 8.

12. The plate according claim 2, said plate being in the form of a panel comprising two upstream and downstream edges and comprising an inlet port in said bypass zone for a coolant fluid and a collection port for the coolant fluid, said means originating from said plate comprising an upstream partition extending from said upstream edge of said plate and configured in such a way as to block the circulation of the fluid at the level of said inlet port and/or said plate comprising a downstream partition extending from said downstream edge of said plate and configured in such a way as to block the circulation of the fluid at the level of said collection port.

13. The plate according to claim 12, in which said inlet port and said collection port being pierced in a zone close to one of said short edges.

14. The plate according to claim 13, in which the lengths of said upstream partition and/or of said downstream partition are identical to or greater than the largest dimension of said ports in the direction of said long edges.

15. The plate according to claim 6, wherein said distal end of said upstream partition is bends towards an interior of a space defined by assembly of two of said plates.

16. The plate according to claim 6, wherein said distal end of said downstream partition is bends towards an exterior of a space defined by assembly of two of said plates.

17. The plate according to claim 1, wherein said upstream partition and said downstream partition are rectangular.

18. The plate according to claim 6, wherein said upstream partition and said downstream partition are rectangular and substantially flat except for said oblique distal end.

* * * * *